US006675982B2

(12) United States Patent
Heil et al.

(10) Patent No.: US 6,675,982 B2
(45) Date of Patent: Jan. 13, 2004

(54) LID WITH A PUMP/BELLOWS DEVICE

(75) Inventors: Ross Heil, Pleasant Hill, CA (US); Robert A. Wilk, Sierra Village, CA (US); Robert B. Carlsen, Mi-Wuk Village, CA (US)

(73) Assignee: Tilia International, Inc., San Francisco, CA (US)

( * ) Notice: Subject to any disclaimer, the term of this patent is extended or adjusted under 35 U.S.C. 154(b) by 0 days.

(21) Appl. No.: 10/081,386

(22) Filed: Feb. 22, 2002

(65) Prior Publication Data

US 2002/0134782 A1 Sep. 26, 2002

Related U.S. Application Data

(60) Provisional application No. 60/271,324, filed on Feb. 23, 2001.

(51) Int. Cl.[7] ..... B65D 51/24

(52) U.S. Cl. ..... 220/212; 215/228; 141/65

(58) Field of Search ..... 220/212, 231, 220/240, 367.1; 215/228, 260, 262, 270, 311; 141/64, 65

(56) References Cited

U.S. PATENT DOCUMENTS

| | | | | |
|---|---|---|---|---|
| 1,521,203 | A | 12/1924 | Roehrig | |
| 2,270,332 | A | 1/1942 | Osborn, Jr. | |
| 2,270,469 | A | 1/1942 | Osborn, Jr. | |
| 2,406,771 | A | 9/1946 | Hughes | |
| 2,416,900 | A | 3/1947 | Busby | |
| 2,436,849 | A | 3/1948 | Billetter | |
| 2,772,018 | A | * 11/1956 | Weiss | 220/231 |
| 2,890,810 | A | 6/1959 | Rohling | |
| 3,129,835 | A | * 4/1964 | Collens | 215/311 |
| 4,016,999 | A | 4/1977 | Denzer | |
| 4,222,276 | A | 9/1980 | DeRogatis | |
| 4,249,583 | A | 2/1981 | Lundbladh | |
| 4,278,114 | A | 7/1981 | Ruberg | |
| 4,372,096 | A | 2/1983 | Baum | |
| 4,442,951 | A | 4/1984 | Nakazawa et al. | |
| 4,660,355 | A | 4/1987 | Kristen | |
| D296,108 | S | 6/1988 | Niedworok | |
| 4,909,014 | A | 3/1990 | Kobayashi et al. | |
| 4,989,745 | A | 2/1991 | Schneider | |
| 5,031,785 | A | 7/1991 | Lemme | 215/228 |
| 5,347,918 | A | 9/1994 | Chen | |
| 5,364,241 | A | 11/1994 | Schultz | |
| 5,390,809 | A | 2/1995 | Lin | |
| 5,405,038 | A | 4/1995 | Chuang | |
| 5,406,992 | A | 4/1995 | Miramon | |
| 5,449,079 | A | 9/1995 | Yang | |
| 5,465,857 | A | 11/1995 | Yang | |
| 5,481,852 | A | 1/1996 | Mitchell | |
| 5,535,900 | A | 7/1996 | Huang | |
| 5,542,583 | A | 8/1996 | Boyer et al. | |
| 5,546,997 | A | 8/1996 | Miramon | |
| 5,558,243 | A | 9/1996 | Chu | |
| 5,564,480 | A | 10/1996 | Chen | |
| 5,564,581 | A | 10/1996 | Lin | |
| 5,611,376 | A | 3/1997 | Chuang | |
| 5,617,893 | A | 4/1997 | Webster | |
| 5,638,971 | A | 6/1997 | Justesen | |
| 5,651,470 | A | 7/1997 | Wu | |
| 5,692,632 | A | 12/1997 | Hsieh et al. | |
| 5,735,317 | A | 4/1998 | Wu | |
| 5,779,082 | A | 7/1998 | Miramon | |
| 5,803,282 | A | 9/1998 | Chen et al. | |
| 5,806,575 | A | 9/1998 | Tsay | |
| 5,806,704 | A | 9/1998 | Jamison | |
| 5,941,391 | A | 8/1999 | Jury | |
| 5,974,686 | A | 11/1999 | Nomura et al. | |
| 6,035,769 | A | 3/2000 | Nomura et al. | |
| 6,044,756 | A | 4/2000 | Chang | |
| 6,045,011 | A | 4/2000 | Yang | |
| 6,253,947 | B1 | 7/2001 | Yang | |
| 6,375,024 | B1 | 4/2002 | Park | |

* cited by examiner

*Primary Examiner*—Nathan J. Newhouse
(74) *Attorney, Agent, or Firm*—Fliesler Dubb Meyer & Lovejoy LLP

(57) ABSTRACT

A lid for vacuum sealing a container has nested first and second valve system for evacuating the container. A lever is alternatively provided for manipulating the valve system.

64 Claims, 10 Drawing Sheets

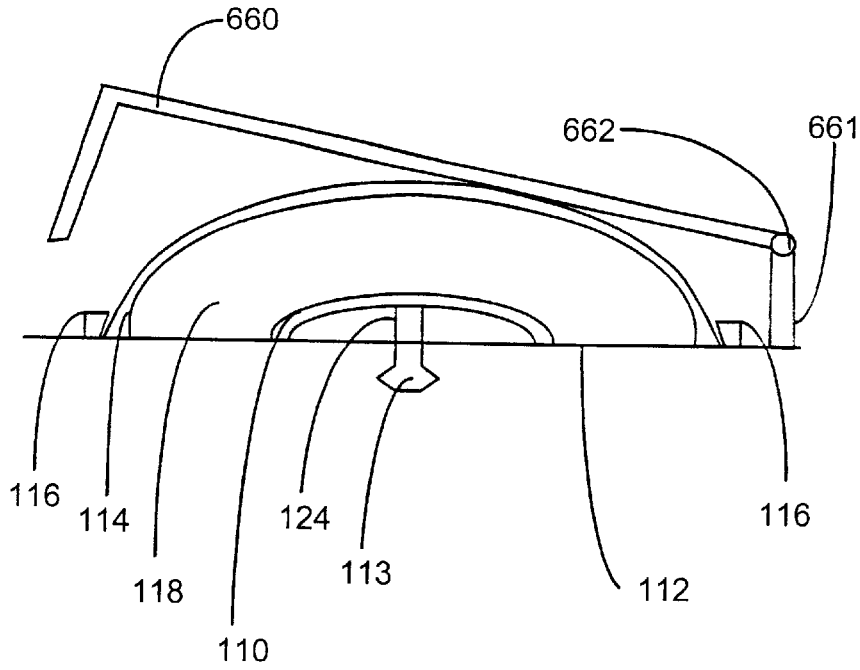
FIG - 6C
FIG - 6D
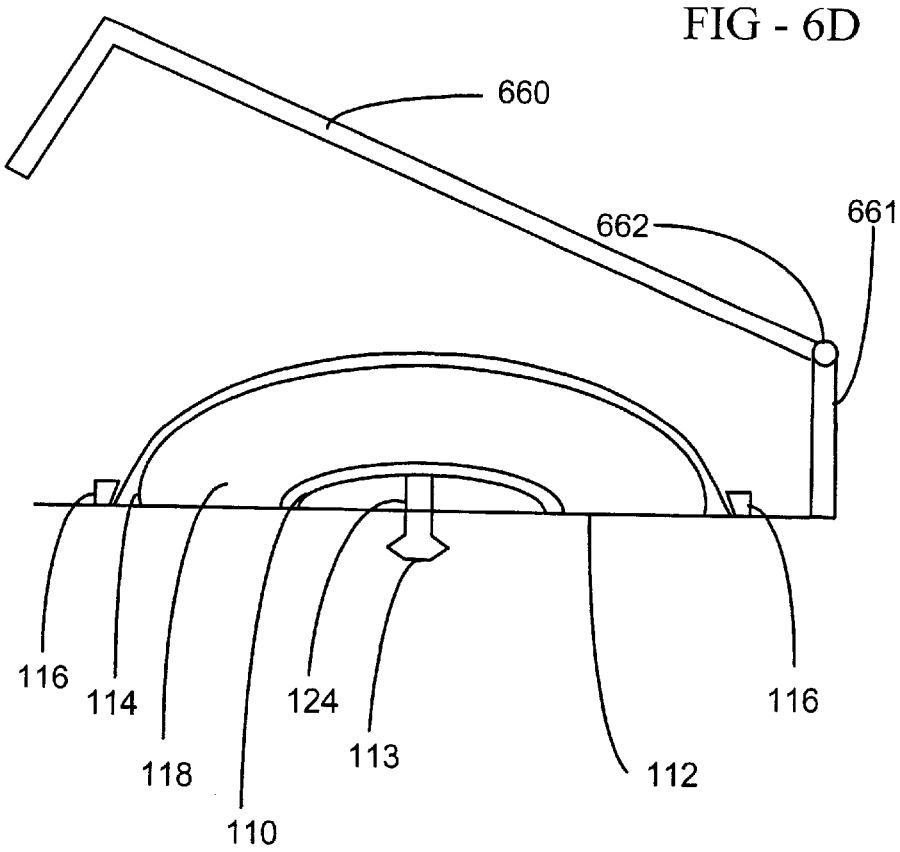

LID WITH A PUMP/BELLOWS DEVICE

CLAIM OF PRIORITY

This application claims priority from provisional application entitled "LID WITH A PUMP/BELLOWS DEVICE", Application No. 60/271,324, filed Feb. 23, 2001, and which application is incorporated herein by reference.

FIELD OF THE INVENTION

The present invention relates generally to containers that store food under a vacuum seal. More particularly, the present invention relates to a lid which contains a pump/bellows device to manually pull a vacuum within the container, thus preserving the food stored within the container.

BACKGROUND

Vacuum packaging food maintains the freshness and flavor of the food three to five times longer than food packaged with conventional storage methods. This improvement is because the amount of oxygen available for interaction with the food is reduced as a result of the vacuum. Thus, microorganisms that require oxygen to grow, such as bacteria and yeast, affect food stored in a vacuum less than food stored using conventional methods. Additionally, vacuum packed foods that are frozen are less affected by freezer bum because there is less cold, dry air to dehydrate the food.

The excess air that accompanies food packed using conventional packaging methods can have a variety of effects on the packaged food. For instance, dry foods can absorb moisture from the atmosphere, thereby becoming soggy. Yet, moist foods can become dry when packaged using conventional methods because air absorbs moisture from the moist food.

An example of a dry food is sugar. When sugar is stored such that moisture from the air can be absorbed, the sugar can harden into a solid block. Such a block is unappealing at the very least. Furthermore, a pound of sugar in the form of a single block is very difficult to use. If the sugar had been packaged in a vacuum, then moisture from the atmosphere could not be absorbed by the sugar. Thus, the sugar would remain in granular form and not turn into a solid block.

An example of a moist food is bread. When bread is stored in such a way as to allow exposure to the atmosphere, the bread tends to dry out and become hard and crusty. If, however, the bread was stored in a vacuumed packed storage container, then the atmosphere could not absorb the bread's moisture. Thus, the bread would maintain the proper amount of moisture and stay fresh and soft.

Bread, however, also suffers from microorganisms like bacteria, yeast, and mold growths due to temperature changes and excess moisture. Storing bread with a conventional packaging method gives the microorganisms access to the atmosphere, thereby permitting the microorganisms to grow. Consequently, the bread becomes unsuitable for consumption. Storing the bread in a vacuum prevents the atmosphere from depositing any new microorganisms or reacting with any existing microorganisms. Thus, the vacuum packaging allows the bread to maintain its freshness.

Yet another example of a food stored in conventional packaging devices is food that is high in fats and oils, such as butter. When food like butter is exposed to the atmosphere, over time it becomes rancid, causing an unpleasant taste and smell. If the butter had been packaged in a vacuum, then the butter could not react with the atmosphere and turn rancid. Hence, the butter stored in a vacuum would remain fresh longer than if it had been packaged using a conventional packaging method.

There are several types of home vacuum packaging systems currently available in the marketplace. For instance, there are manually operated vacuum pumps. These systems typically consist of a small, manually-operated pump which can be used to extract air from a container. Although they do not completely remove the air from the container, they do help food last longer. Another example of a home vacuum system is a bag sealer that includes a fan. Such a systems uses a small rotary fan to extract some air out of a plastic bag before the bag is sealed. Several different bag configurations are available in the market for such a bag sealer/fan system. For instance, one such system uses a polyethylene bags. Other bag sealer/fan system use sheets of plastic from which bags of different lengths can be made. This variable bag system "welds" the seams of the plastic sheets with a heated wire bag-sealing mechanism, thereby forming a closed bag. However, the fans in these home vacuum packaging systems do not have the ability to create a vacuum. This can be seen because the plastic used for the containers will loosely form around the contours of the food in the bag, but it will be obvious that air remains in the bag. Also, the strength of the seal and the material used for the bag in these home vacuum packaging systems will determine whether any air, atmosphere, or oxygen can re-enter the bag.

Another type of home vacuum packaging systems uses an electric pump systems. These systems are the only storage systems that eliminate exposure to oxygen. They use electric-powered piston pumps to first extract air from a container. Then, the container is sealed to prevent any air, atmosphere, or oxygen from re-entering the sealed container. A consumer using such a home vacuum packaging systems can easily see that a vacuum is formed, when the container used to seal the food is a bag, because the bag will shape itself tightly around the food. Yet, when the container is more ridged, like a jar or a glass dish, a change in the physical shape of the container cannot be seen when the vacuum is present.

SUMMARY OF THE INVENTION

It is an object of an embodiment of the present invention to create a vacuum sealable container where the vacuum seal is achieved manually by a pump/bellows lid to prevent air from re-entering into the container.

Thus, there is a need for an improved lid to manually pump the air out of a container to achieve a vacuum seal.

BRIEF DESCRIPTION OF THE DRAWINGS

FIG. 6C depicts a cross-sectioned view of another embodiment of the invention with a handle in the open position connected with a bellows.

FIG. 6D depicts a cross-sectioned view of yet another embodiment of the invention with a handle in the open position.

DETAILED DESCRIPTION OF THE INVENTION

Figure 1:
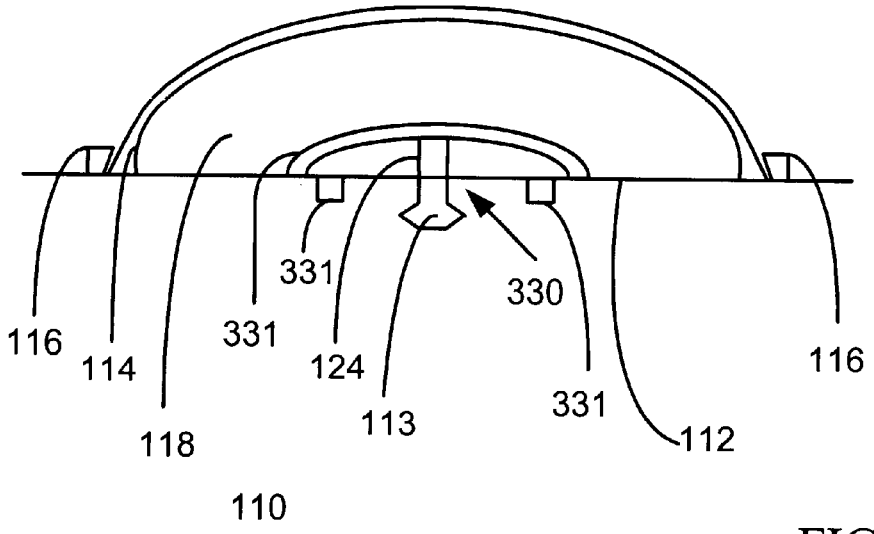
FIG. 1 depicts a cross-sectioned view of an embodiment of a duel valve bellows system of an embodiment of the invention.

FIG. 1 depicts a cross-sectioned view of an embodiment of a duel valve bellows system of an embodiment of the invention. A first valve 110 is connected with a stem 124. The stem 124 is connected with a stopper 113. The first valve 110 is connected with a lid surface 112 with stem 124 movable through an evacuation port 330 in lid surface 112. Lid surface 112 also includes a plurality of additional evacuation ports 331 that are covered by first valve 110. A second valve 114 is located such that the first valve 110 is between the second valve 114 and the lid surface 112, thereby forming a bladder 118. A guide 116 is connected with the lid surface and proximate to the second valve 114.

When the lid surface is connected with a container such that an enclosed volume is located below the lid surface 112, the embodiment of the duel valve bellows system depicted in FIG. 1 can be used to create a vacuum inside the container. The second valve 114 is composed of a flexible material (e.g. rubber, flexible plastic, etc.) A force is applied to the second valve 114, thereby deforming the second valve 114 and expelling the contents of bladder 118. The guide 116 allows the second valve to move such that an escape path for the contents of the bladder can be formed under the peripheral edge of the second valve. When the force is removed, the deformed second valve 114 can regain its original shape. The second valve 114 can be guided back into place over the first valve 110 by the guide 116.

As the second valve 114 regains its original shape, it forms a seal with the lid surface 112 and forms a first vacuum that pulls the first valve 110 towards the second valve 114 and away from the lid surface 112. As the first valve 110 is pulled from the lid surface 112, material from the enclosed container located below the lid surface is drawn from the container through evacuation ports 115 and 112 and into bladder 118. As the second valve 114 regains its original shape and the bladder 118 is filled, the atmospheric pressure in the bladder 118 is equalized with the container, thereby allowing the first valve 110 to settle back into its original sealing position over ports 330 and 331. The stem 124 and stopper 113 control the range of movement by the first valve 110 such that the first valve 110 can regain its original position between the lid surface 112 and the second valve 114.

As additional forces are applied to the second valve 114, thereby deforming and reforming the second valve 114, more material is removed from the container, causing a vacuum to be formed inside the container. Materials that can be removed from the container include gasses, such as air, oxygen, and nitrogen. The material could also be a liquid, such as water or tomato soup.

Figure 2:
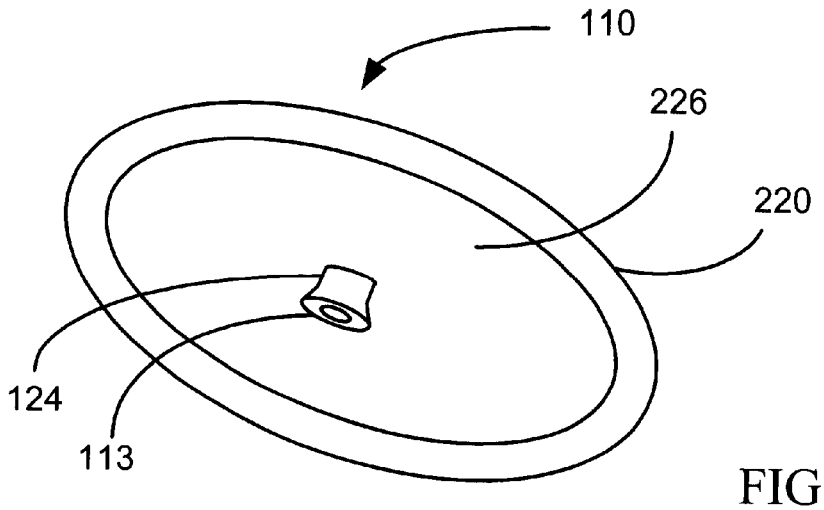
FIG. 2 depicts a perspective view of an embodiment of a first valve of an embodiment of the invention of FIG. 1.

FIG. 2 depicts a perspective view of an embodiment of a first valve of an embodiment of the invention of FIG. 1. Shown is the underside of the first valve 110, which includes a first valve seal 220 provided at the peripheral edge of a first valve bottom surface 226. The first valve bottom surface 226 is provided with a stem 224, which is in turn provided with a stopper 213. The first valve 110 has a generally domed shape.

An alternate embodiment of the first valve seal 220 can have the first valve seal 220 form different geometrical shapes. For instance, the first valve seal 220 could form a triangle, square, pentagon, hexagon, or other polygonal shape. While the shape of the first valve seal 220 can vary, the general shape of the first valve 110 maintains a generally domed shape.

Figure 3:
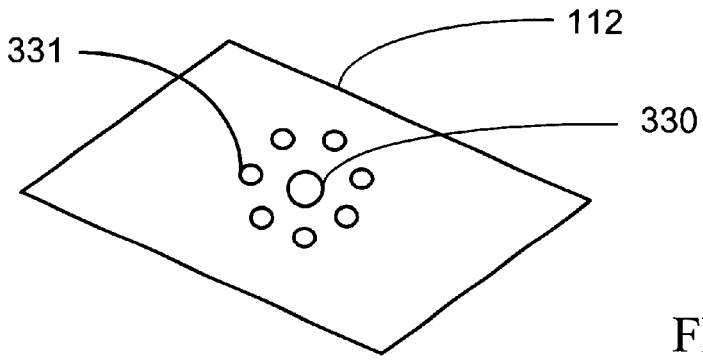
FIG. 3 depicts a perspective view of a section of a lid surface of an embodiment of the invention.

FIG. 3 depicts a perspective view of a section of a lid surface of an embodiment of the invention. The lid surface 112 includes an evacuation port 330 and other evacuation ports 331. The stem 224 of valve 110 from FIGS. 1 and 2 loosely fits inside of the port 330. Thus, the stem 224 can move in all directions but is limited in the range of movement by the dimensions of the evacuation port 330, the stem 112 and the stopper 113.

While the evacuation port 330 of FIG. 3 is shown to be generally circular in shape, it is not limited to only being a circle. Any shape that can control the range of movement exhibited by stem 124 can be used.

Figure 4A:
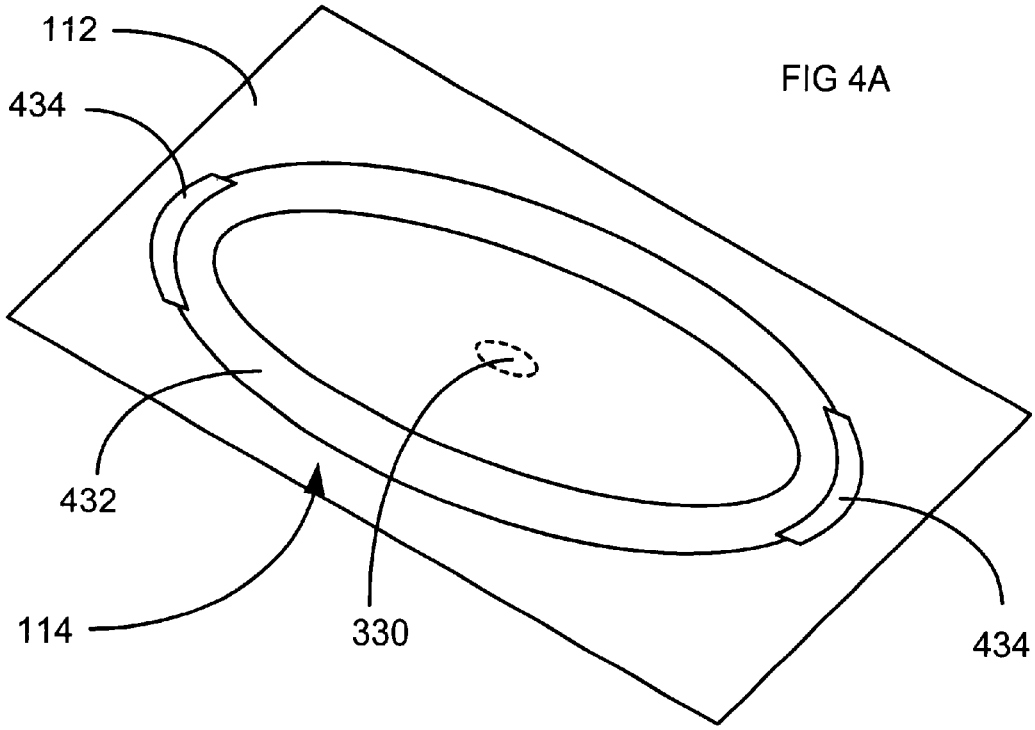
FIG. 4A depicts a perspective view of an embodiment of a securing device of an embodiment of the invention.

FIG. 4A depicts a perspective view of an embodiment of a securing device of an embodiment of the invention. A second valve 114 located on top of the lid surface 112 is shown. The second valve 114 includes a second valve seal 432 that makes contact with the lid surface 112. A securing device, or a guide 434, secures the second valve 114 such that its range of movement is limited.

When a force is applied to the second valve 114, the second valve 114 can move in a lateral direction along the surface of the lid surface 112 as well as extending away from the lid surface 112. One such cause of movement extending away from the lid surface 112 can be from the expulsion of gaseous material from a bladder located under the second valve 114. The two guides 434 shown in FIG. 4A have a curve that mimics the curve of the second valve seal 434. The guides 434 are sufficient in size to maintain the second valve 114 in a range of positions to function as a bellows with a first valve located below the second valve 114.

Figure 4B:
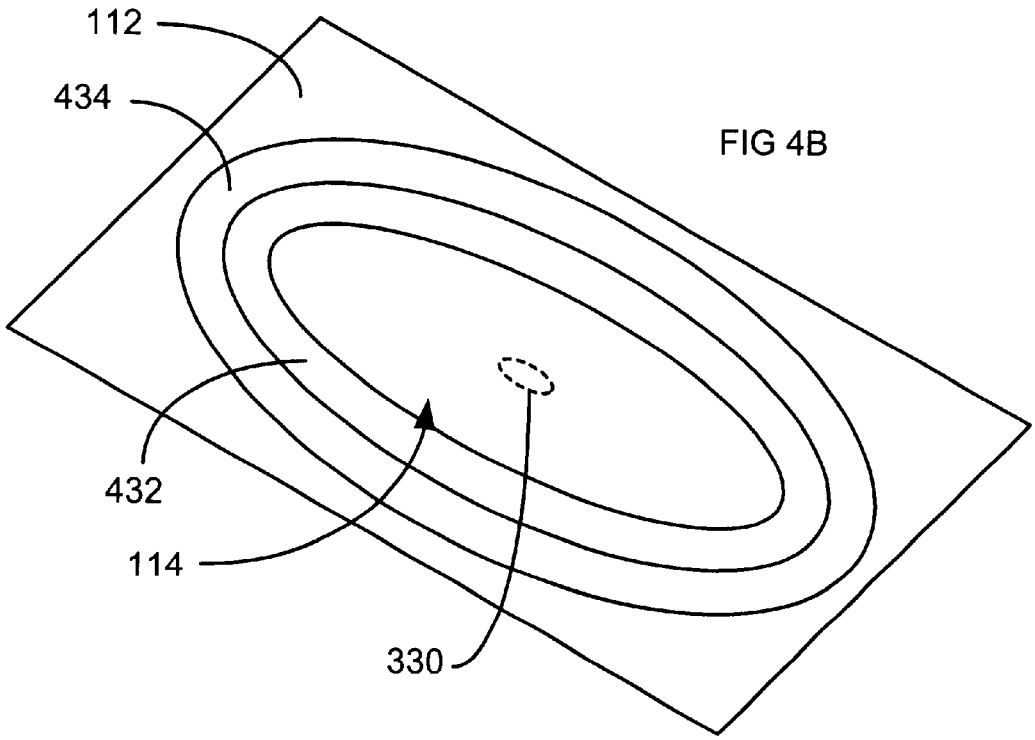
FIG. 4B depicts a perspective view of a securing device of an embodiment of the invention.

FIG. 4B depicts a perspective view of a securing device of an embodiment of the invention. The same second valve 114 is shown in FIG. 4B, yet, an alternate embodiment of a guide 434 is shown. The guide 434 of FIG. 4B completely encompasses the circumference of the second valve seal 432.

Figure 4C:
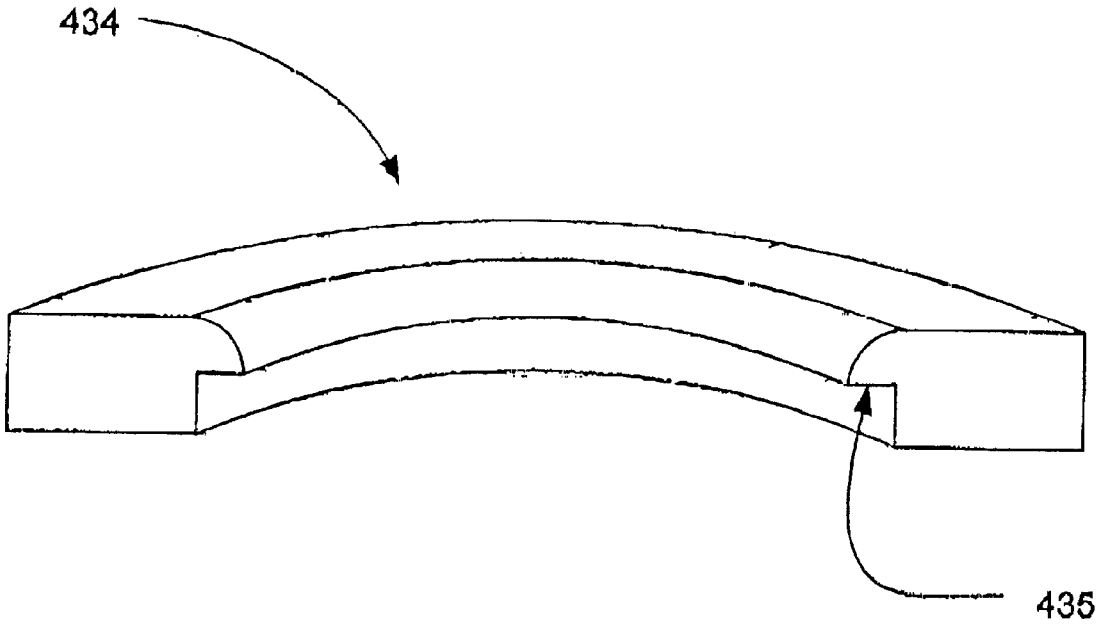
FIG. 4C depicts a cross-sectioned view of the securing device of an embodiment of the invention depicted in FIG. 4B.

FIG. 4C depicts a cross-sectioned view of a securing device, or guide, of an embodiment of the invention depicted in FIG. 4B. Thus, the securing device, or guide 434, includes a ledge 435. The ledge 435 controls the movement of the second valve 114 from FIG. 4B such that the second valve can extend away from the lid surface 112 up to a predetermined distance.

Figure 4D:
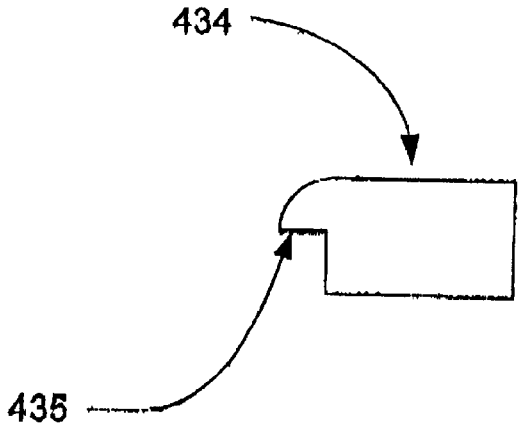
FIG. 4D depicts another cross-sectioned view of an embodiment of the securing device of the embodiment of the invention.

FIG. 4D depicts another cross-sectioned view of an embodiment of the securing device of the embodiment of the invention of FIG. 4C.

Figure 5A:
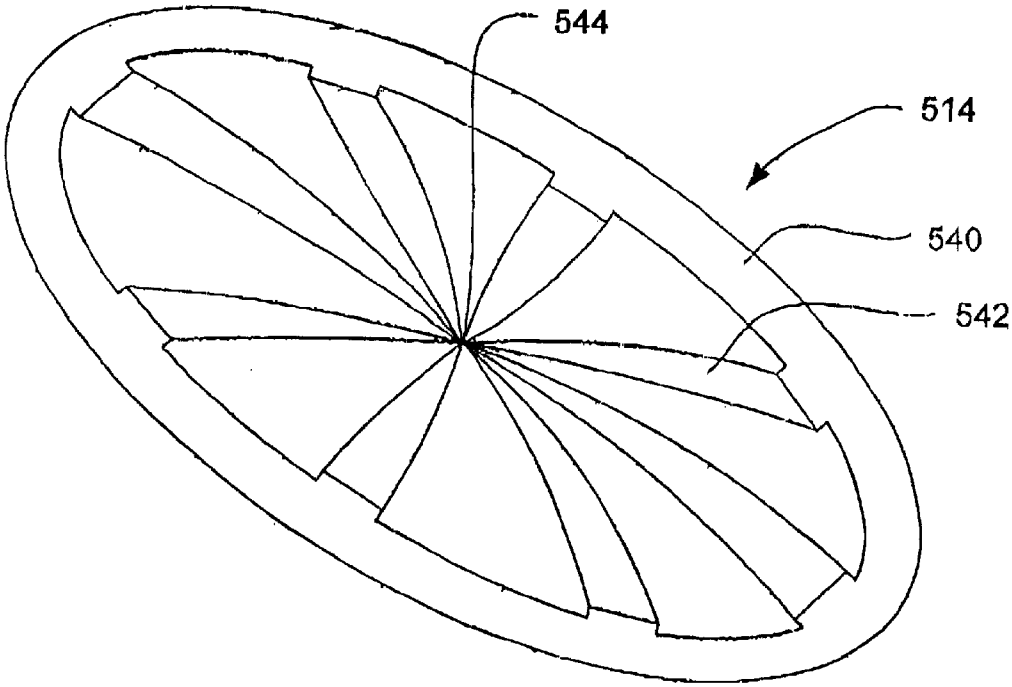
FIG. 5A depicts a perspective view of an embodiment of the underside of a second valve of an embodiment of the invention.

FIG. 5A depicts a perspective view of an embodiment of the underside of a second valve of an embodiment of the invention. The second valve 514 includes a second valve seal surface 540 and a second valve center 544. Extending from the second valve seal surface 540 to the second valve center 544 are a plurality of supports 542.

The supports 542 provide additional rigidity to the second valve 514. Thus, when a deforming force is removed from the second valve 514, as described in FIG. 1, the supports can assist in returning the second valve 514 to its original form.

Figure 5B:
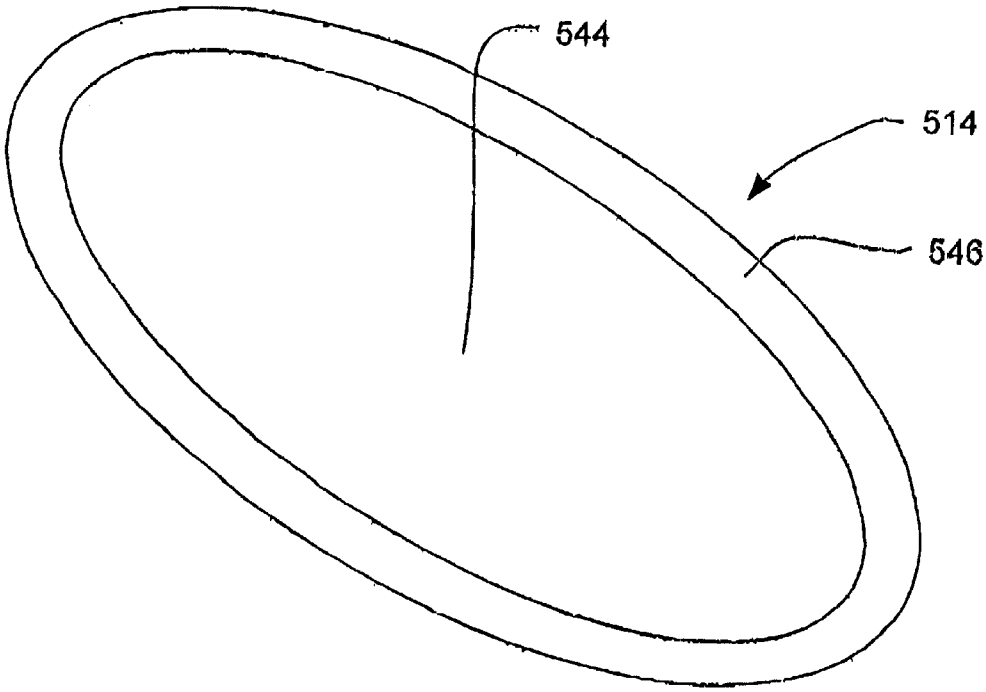
FIG. 5B depicts a perspective view of an embodiment of the underside of a second valve of an embodiment of the invention.

FIG. 5B depicts a perspective view of an embodiment of the underside of a second valve of an embodiment of the invention. While FIG. 5A described a second valve 514 with supports 542, the second valve 514 can be made without supports 542, as shown in FIG. 5B. Thus, a second valve 550 includes a seal surface 546 and a valve center 548. The second valve 550 can be made from a resilient material. Thus, when the second valve 550 is deformed by the application of a force, it will regain its shape after the force is removed.

A variety of materials can be used for the second valve 514. For instance, a somewhat ridged plastic could be used. Alternatively and preferably, a highly flexible material such as rubber could be used for the second valve 514. A rubber second valve 514 could also have supports 542 made from a more ridged rubber or a ridged plastic. Alternatively, the supports could include a spring (not shown) that more quickly returns the second valve 514 back to its original form once the force that deformed the second valve 514 is removed.

Figure 6A:
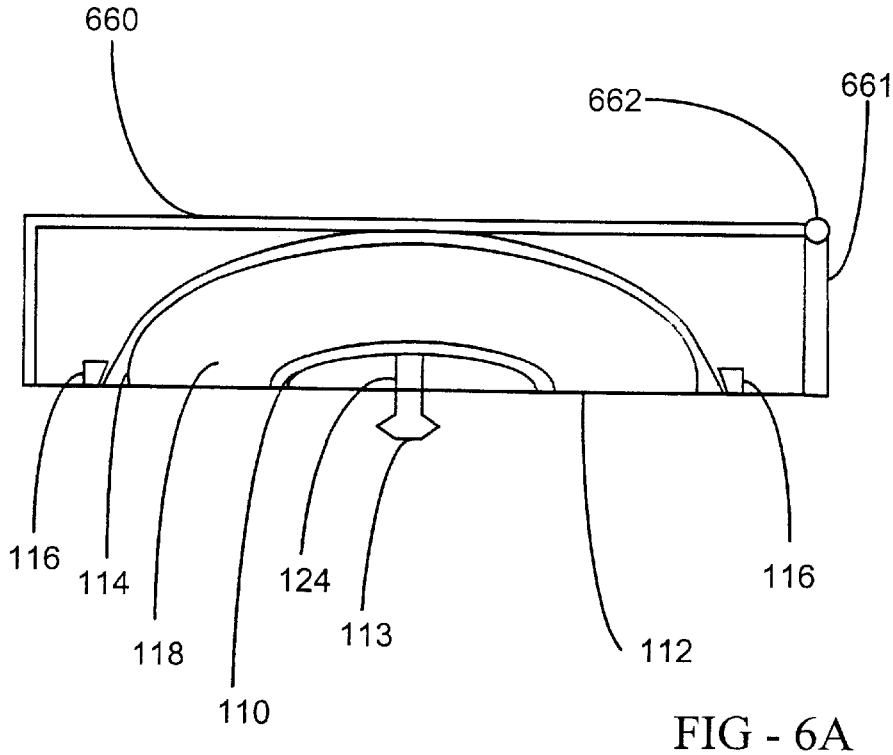
FIG. 6A depicts a cross-sectioned view of an embodiment of the invention with a handle in a closed position connected with a bellows.

FIG. 6A depicts a cross-sectioned view of an embodiment of the invention with a handle in a closed position connected with a bellows. A handle 660 is connected with a hinge 662. The hinge 662 is connected with a lid 661 that includes a lid surface 112. The handle 660 is positioned over the embodiment of a duel valve bellows system of FIG. 1. Thus, when access to the duel valve bellows system of FIG. 1 is not required, the handle 660 can be positioned over the duel valve bellows system, thereby protecting it from any undesired forces. Also in another embodiment described below the handle can be used to deform or pump the second valve 114 in order to evacuate the container.

Figure 6B:
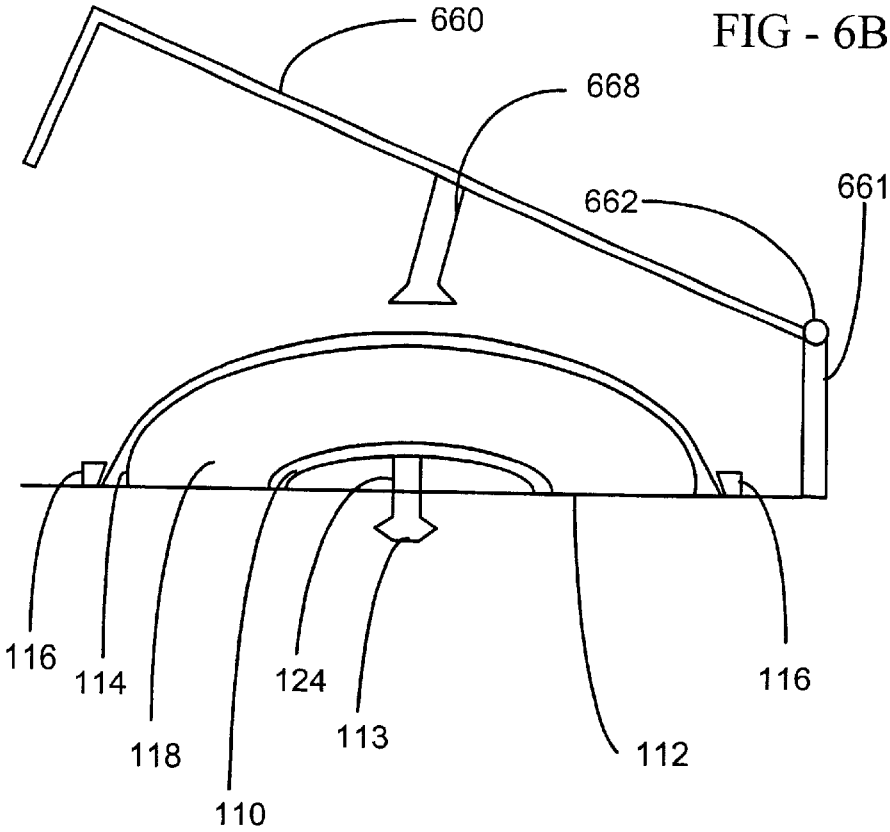
FIG. 6B depicts a cross-sectioned view of an embodiment of the invention with a handle in the open position connected with a plunger.

FIG. 6B depicts a cross-sectioned view of an embodiment of the invention with a handle in the open position connected with a plunger. The handle 660 is coupled with the lid 661 in a similar manner as described in FIG. 6A. The handle 660, however, is shown in an open position. Also, the handle 660 is connected with a collapsible plunger 668 that can be connected, if desired, with the second valve 114 of the duel valve bellows system of FIG. 1. FIG. 6B shows the collapsible plunger 668 that is not connected with the second valve 114. As the handle 660 is pivoted towards a closed position at the hinge 662, the collapsible plunger 668 makes contact with the second valve 114, thereby applying a force that deforms the second valve 114 of the duel valve bellows system of FIG. 1. The handle 660 can also be pivoted towards an open position at hinge 662, thereby causing the collapsible plunger 668 to remove the force causing the deformation of the second valve 114 of the duel valve bellows system of FIG. 1. Thus, the second valve 114 can regain its original shape, causing the first valve 110 to permit material to pass from the container to the bladder 118, as described in FIG. 1.

When the handle 660 is positioned into a closed position, such as shown in FIG. 6A, the collapsible plunger 668 can nestle into a compartment formed by handle 660, hinge 662, lid 661 and lid surface 112. The compartment can store both the duel valve bellows system and the collapsible plunger 668.

In another embodiment as discussed above, the collapsible plunger 668 is connected with the second valve 114. Thus, when the handle 660 is pivoted at the hinge 662 towards a closed position, the collapsible plunger 668 applies a force to the second valve 114, thereby deforming the second valve 114 and expelling the material in the bladder 118 as described in FIG. 1. When the handle is pivoted at the hinge 662 towards an open position, then the collapsible plunger 668 pulls on the second valve 114, thereby pulling the second valve 114 back into its original form. Consequentially, the first valve 110 permits the material in a container located below the lid surface 112 to enter the bladder 118 as described in FIG. 1. In such an arrangement with the plunger 668 connected also to the second valve, lifting the handle 660 pulls the second valve 114 away from the lid surface 112 to assist in evacuation the container.

FIG. 6C depicts a cross-sectioned view of another embodiment of the invention with a handle in the open position connected with a bellows. The handle 660 of FIG. 6C can apply the force that deforms the second valve 114, thereby causing the material in bladder 118 to be expelled. Pivoting the handle 660 to the open position can remove the deforming force from the second valve 114. Alternatively, handle 660 can be connected with the second valve 114, thus providing a force that assists the second valve 114 to regain its original form. When the lid 660 of FIG. 6C is positioned into a fully closed position, similar to the depicted in FIG. 6A, then the second valve 114 can become deformed. Thus, the pivoting of handle 660 at hinge 662 to an open position will draw material from a container located below lid surface 112 past the first valve 110 and into the bladder 118 as described in FIG. 1.

FIG. 6D depicts a cross-sectioned view of yet another embodiment of the invention with a handle in the open position. Alternatively to the embodiments described in FIGS. 6A—6C, the embodiment depicted in FIG. 6D shows the handle 660 in an open position, permitting access to the duel valve bladder system of FIG. 1. Once exposed, the duel valve bladder system can be operated as described in FIG. 1.

Figure 7A:
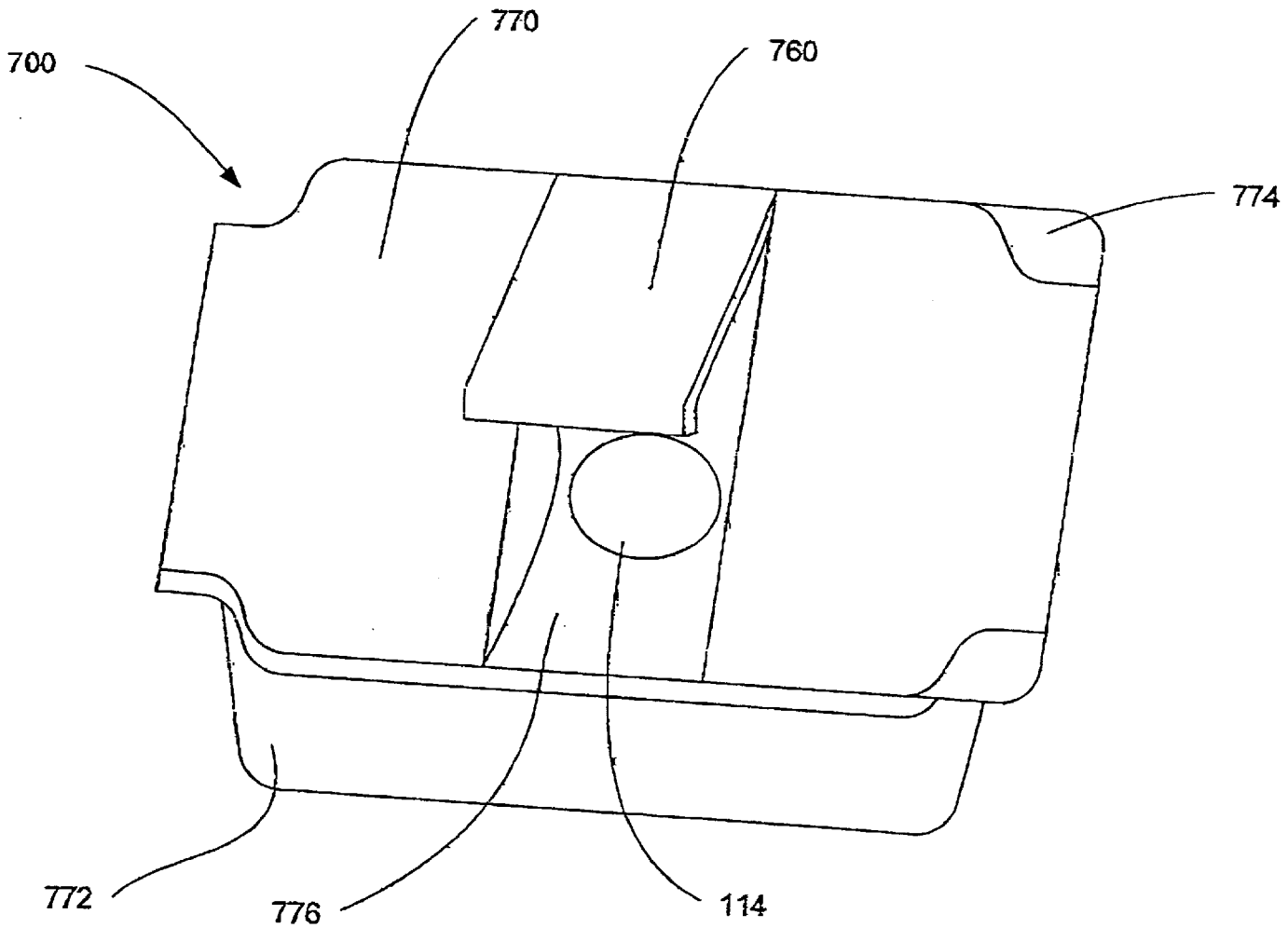
FIG. 7A depicts a perspective view of an embodiment of the invention with a lid connected with a container and a handle in the open position.

FIG. 7A depicts a perspective view of an embodiment of the invention with a lid connected with a container and a handle in the open position. A lid 700 is connected with a container 772, forming a seal along the perimeter of the container. A gasket element can be used to form an air-tight seal. The lid 700 includes a first lid surface 776 and a second lid surface 770. Connected with the lid is a handle 760. The handle 760 and the first lid surface 776 form a compartment that includes a second valve 114 that is connected with the first lid surface 776. The second valve 114 is part of the duel valve bellows system described in FIG. 1. The positioning of the handle 760 in the open position allows access to the second valve 114. Additionally, the lid removal device 774 can be used to remove the lid 700 from container 772. In such arrangements the handle 760 can be used to protect the duel valves bellows systems, and/or pump the system, and/or be connected to and pump the system as demonstrated with the embodiments above.

Figure 7B:
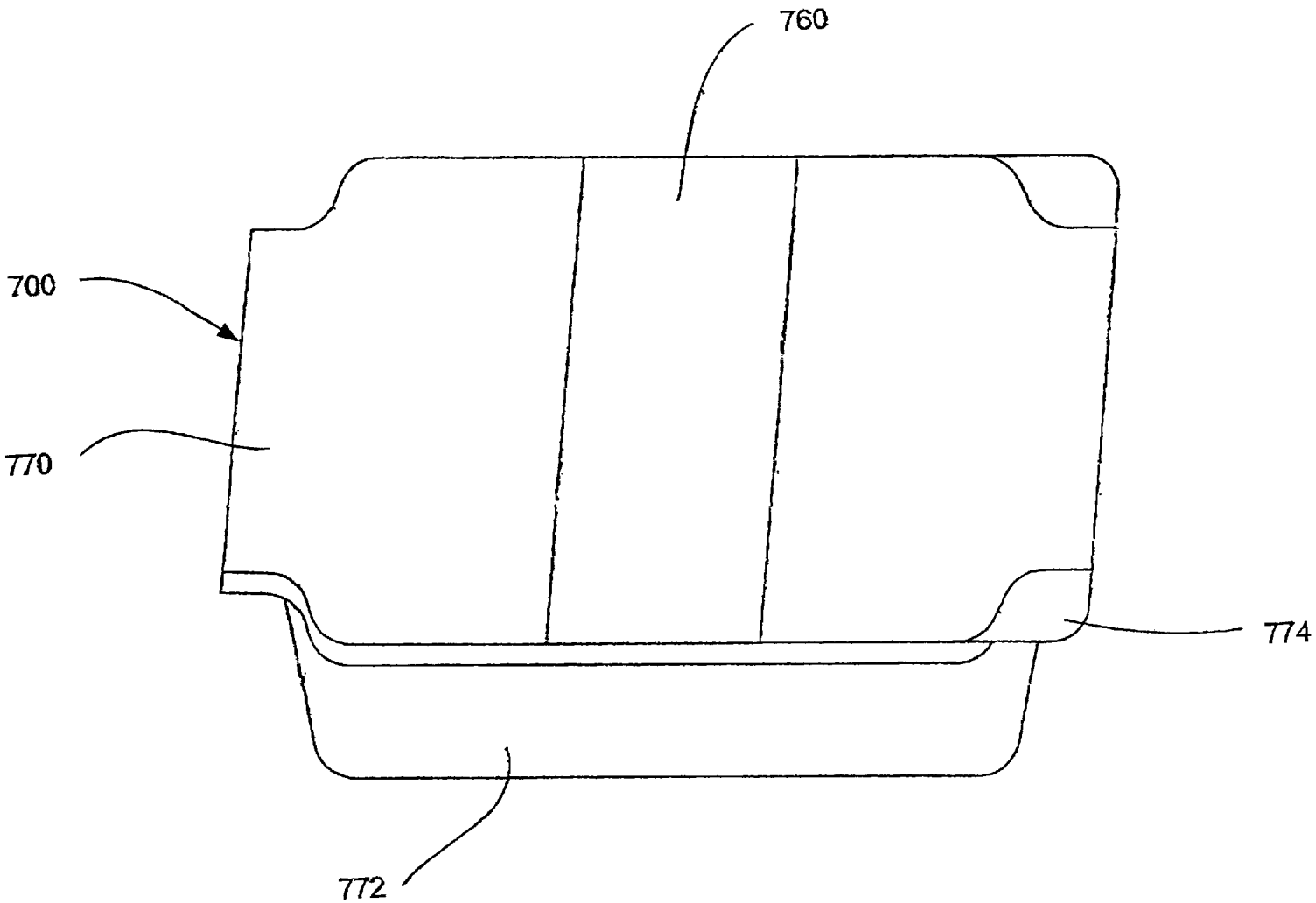
FIG. 7B depicts a perspective view of the embodiment of the invention of FIG. 7A with a lid connected with a container and a handle in the closed position.

FIG. 7B depicts a perspective view of the embodiment of the invention of FIG. 7A with a lid connected with a container and a handle in the closed position. The second lid surface 770 and the handle 760 can form a substantially flat surface where other containers can be placed.

Figure 8A:
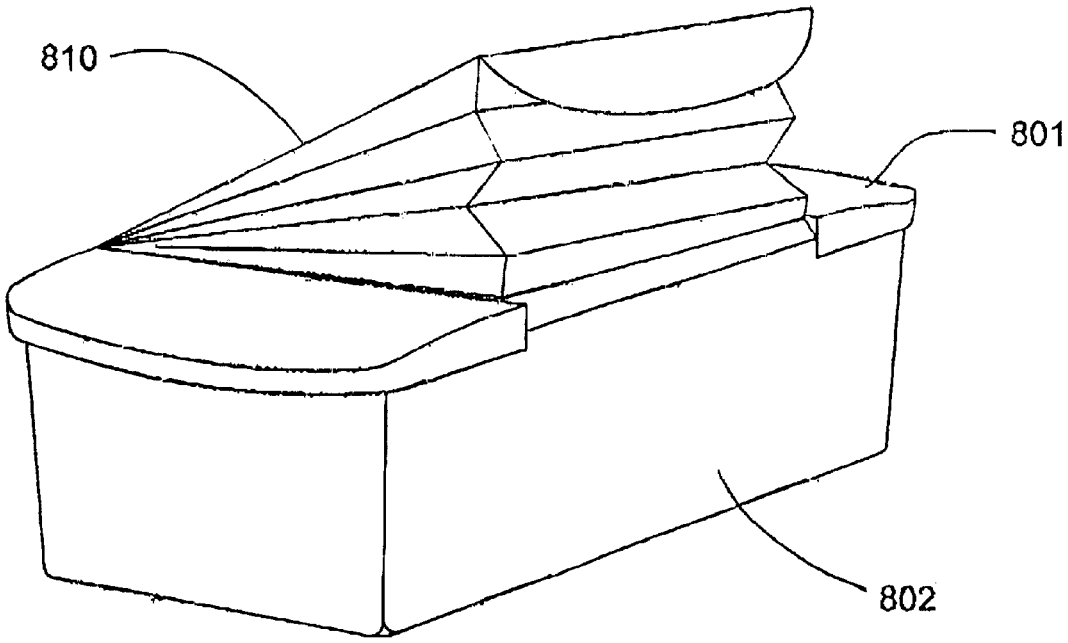
FIG. 8A is a perspective view of another embodiment of the present invention illustrating the expandable middle section in an open position.

FIG. 8A is a perspective view of another embodiment of the present invention illustrating the expandable middle section in an open position. Lid 801 is connected with container 802, forming a seal along the perimeter of the container. A gasket can be used to form the seal. The lid 801 is connected with a handle 809 and a middle section 810. The middle section 810, includes a flexible, accordion like, bellows, a first valve and a second valve 812.

Figure 8B:
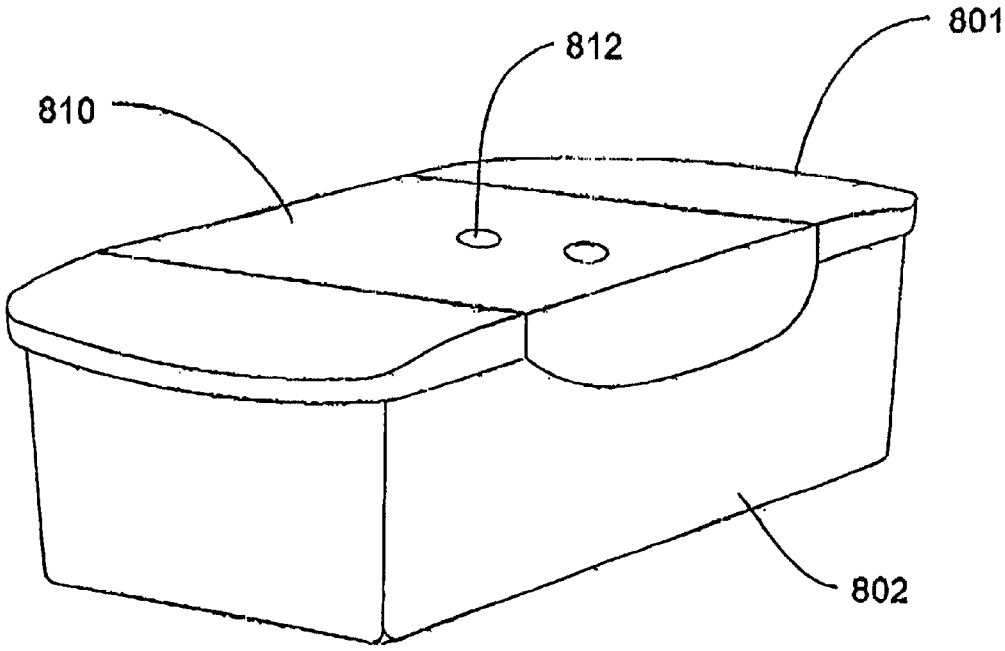
FIG. 8B is a perspective view of the embodiment of the present invention of FIG. 8A with the expandable middle section in the closed position.

As the middle section 810 is moved from a closed position, as depicted in FIG. 8B, to an open position, as depicted in FIG. 8A, material from the container 802 is draw into the middle section 810 through the first valve. As the middle section 810 is moved from the open position to the closed position, the material in the middle section 810 escapes from the middle section 810 through the second valve. The first valve prevents the material from re-entering the container 802. Repeated movements of the middle section 810 from a closed position, to an open position can draw enough material from the container 802 to create a vacuum inside of the container 802.

The material removed from container 802 can be any of the materials discussed above under FIG. 1. For instance, air can be removed from the container 802, which can include oxygen.

FIG. 8B is a perspective view of the embodiment of the present invention of FIG. 8A with the expandable middle section in the closed position. The second valve 812 can be seen on top of the middle section 810. When the middle section 810 is in a closed position, the lid 801 can form a substantially flat surface, thereby allowing additional containers to be stacked on top of the lid 801.

Figure 9A:
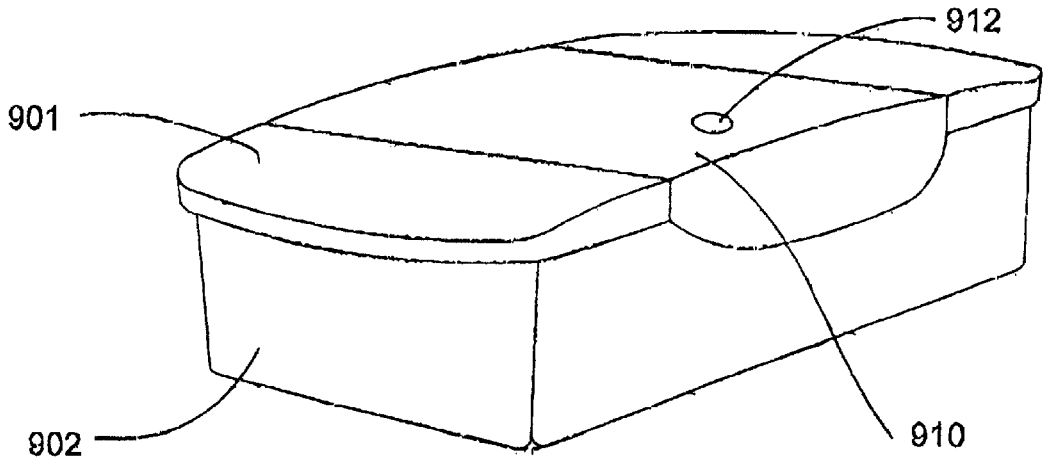
FIG. 9A is a perspective view of another embodiment of the present invention with the expandable middle section in the closed position.

FIG. 9A is a perspective view of another embodiment of the present invention with the expandable middle section in the closed position. A lid 901 is connected with a container 902. The lid 901 is connected with a middle section 910 that includes a second valve 912. The closed position of the middle section 910 depicted in FIG. 9A can form a substantially flat surface for lid 901, thereby permitting other items to rest on top of lid 901. In an alternate embodiment, when the middle section 910 is in a closed position, a raised surface can be formed with the lid 901, as shown by the front view of an embodiment of the invention shown in FIG. 9C.

Figure 9B:
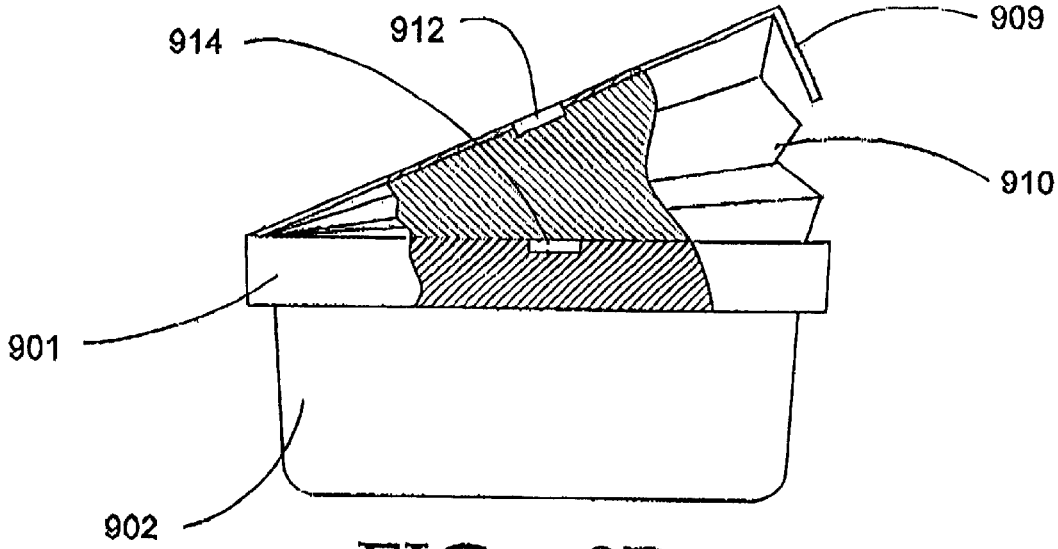
FIG. 9B is a partial cut-away view illustrating two one-way valves located in the expandable middle section of the embodiment of the invention of FIG. 9.
Figure 9C:
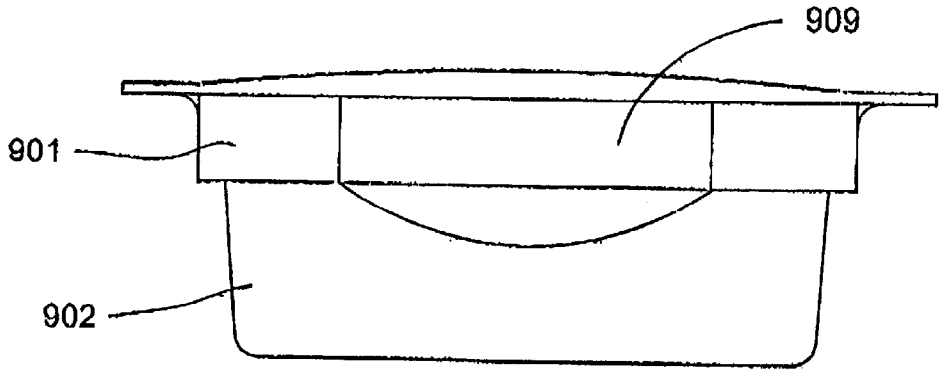
FIG. 9C is a front view of an embodiment of the present invention with the expandable middle section in the closed position.

FIG. 9B is a partial cut-away view illustrating two one-way valves located in the expandable middle section of the embodiment of the invention of FIG. 9. The lid 901 is connected with a container 902. The lid 901 includes a first valve 914, preferably a one-way valve, connected with a middle section 910. The middle section 910 is connected with a handle 909. The handle includes a second valve 912, preferably a one-way valve.

The handle can be used to raise the middle section 910 from a closed position, as depicted in FIG. 9A, to an open position as depicted in FIG. 9B. When the middle section 910 is raised to an open position, material from container 902 is drawn through the first valve 914 into the middle section 910. As the middle section 910 is collapsed, the material in the middle section 910 escapes from the middle section 910 through the second valve 912. Repeated opening and closing of the middle section can remove material from the container 902, thereby creating a vacuum inside of container 902.

Typical materials removed from container 902 through the actuation of the middle section 910 between an open and closed position can include air, oxygen, and nitrogen. Liquids can also be extracted from the container.

The foregoing description of preferred embodiments of the present invention has been provided for the purposes of illustration and description. It is not intended to be exhaustive or to limit the invention to the precise forms disclosed. Obviously, many modifications and variations will be apparent to the practitioner skilled in the art. The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the following claims and their equivalence.

We claim:

1. A container lid to manually create a vacuum within a container, the lid comprising:

a first valve coupled with a lid surface, the first valve including a first membrane, a stem, and a stopper;

a second valve connected with the lid surface, the second valve having an initial shape; and a guide connected with the lid surface to hold at least a portion of the second valve inside of said guide;

wherein elasticity of the second valve urges the second valve to conform to the initial shape;

whereby in the absence of force, a deformed second valve returns to the initial shape.

2. The container lid of claim 1, wherein:

the first valve is underneath the second valve, forming a bladder between the first valve and the second valve.

3. The container lid of claim 2, wherein:

the initial shape is generally dome shaped;

and the first valve forms a seal with the lid surface.

4. The container lid of claim 3, wherein:

the dome shape of the second valve is deformed; and a first volume of air is removed from the bladder.

5. The container lid of claim 4, wherein:

the shape of the second valve is returned to the generally dome shape it had before being deformed, the seal formed by the first valve with the lid is broken; and air moves from underneath the lid to the bladder.

6. The container lid of claim 1, wherein:

the first valve is a flexible material; and the second valve is a flexible material.

7. The container lid of claim 1, wherein:

the guide is positioned around the circumference of the second valve.

8. The container lid of claim 7, wherein:

the guide includes a plurality of guide members.

9. A container lid to manually pull a vacuum within the container, the lid comprising:

a first lid surface;

a first valve coupled with the first lid surface, the first valve including a first membrane, a stem, and a stopper;

a second valve connected with the first lid surface, the second valve having an initial shape;

a guide connected with the first lid surface to hold at least a portion of the second valve inside of said guide; and a lever connected with the first lid surface;

wherein elasticity of the second valve urges the second valve to conform to the initial shape;

whereby in the absence of force, a deformed second valve returns to the initial shape.

10. The container lid of claim 9, including:

a second lid surface connected to the first lid surface; and the first lid surface is recessed into the second lid surface.

11. The container lid of claim 10, wherein:

the lever in a closed position covers the first lid surface forming a substantially flat surface.

12. The container lid of claim 10, wherein:

the lever in a open position exposes the first lid surface, the second valve, and the guide.

13. The container lid of claim 10, wherein:

the first valve is underneath the second valve, forming a bladder between the first valve and the second valve.

14. The container lid of claim 13, wherein:

the initial shape is generally dome shaped;

and the first valve forms a seal with the first lid surface.

15. The container lid of claim 14, wherein:

the dome shape of the second valve is deformed; and a first volume of air is removed from the bladder.

16. The container lid of claim 15, wherein:

as the shape of the second valve is returned to the generally dome shape it had before being deformed, the seal formed by the first valve with the lid is broken; and air moves from underneath the lid to the bladder.

17. The container lid of claim 9, wherein:

the first valve is a flexible material; and the second valve is a flexible material.

18. The container lid of claim 9, wherein:

the guide is positioned around the circumference of the second valve.

19. The container lid of claim 18, wherein:

the guide includes a plurality of guide members.

20. A container lid to manually pull a vacuum within the container, the lid comprising:

a first surface;

a first valve coupled with the first lid surface, the first valve including a first membrane, a stem, and a stopper;

a second valve having an initial shape;

a guide connected with the first lid surface, the guide to hold at least a portion of the second valve inside of said guide;

a lever connected with the second lid surface; and the lever connected with the second valve;

wherein elasticity of the second valve urges the second valve to conform to the initial shape;

whereby in the absence of force, a deformed second valve returns to the initial shape.

21. The container lid of claim 20, wherein:

the first valve is a flexible material; and the second valve is a flexible material.

22. The container lid of claim 20, wherein:

the guide is positioned around the circumference of the second valve.

23. The container lid of claim 20, including:

a second lid surface connected to the first lid surface; and the first lid surface is recessed into the second lid surface.

24. The container lid of claim 23, wherein:

the lever in a closed position covers the first lid surface forming a substantially flat surface.

25. The container lid of claim 23, wherein:

the lever in a open position exposes the first lid surface, the second valve, and the guide.

26. The container lid of claim 23, wherein:

the first valve is underneath the second valve, forming a bladder between the first valve and the second valve.

27. The container lid of claim 27, wherein:

the initial shape is generally dome shaped; and the first valve forms a seal with the first lid surface.

28. The container lid of claim 27, wherein:

the dome shape of the second valve is deformed; and a first volume of air is removed from the bladder.

29. The container lid of claim 28, wherein:

as the shape of the second valve is returned to the generally dome shape it had before being deformed, the seal formed by the first valve with the lid is broken; and air moves from underneath the lid to the bladder.

30. The container lid of claim 27, wherein:

the lever in a closed position covers the first lid surface forming a substantially flat surface with the second surface; and the lever in a open position exposes the first lid surface, the second valve, and the guide.

31. The container lid of claim 30, wherein:

moving the lever from the open position to the closed position deforms the dome shape of the second valve; and a first volume of air is removed from the bladder.

32. The container lid of claim 31, wherein:

moving the lever from the closed position to the open position permits the second valve to return to the generally domed shape it had before being deformed, and the seal formed by the first valve with the lid is broken; and air moves from underneath the lid to the bladder.

33. The container lid of claim 31, wherein:

the guide includes a plurality of guide members.

34. A container lid to create a vacuum within a container, the lid comprising:

a surface;

a first valve that can selectively seal the container;

a second valve located above the first valve;

a first bladder defined between the first valve and the second valve;

a second bladder defined between the first valve and the surface; and a port through the surface that is adapted to communicate the container with the second bladder.

35. The container lid of claim 34 wherein said first valve is nested in said second valve.

36. The container lid of claim 34 including a lever for manipulating the second valve.

37. The container lid of claim 34 including a lever connected to the first and the second valves.

38. The container lid of claim 34 including a container and the container lid can engage said container.

39. The container lid of claim 34 wherein:

said first valve has a peripheral edge and said second valve has a peripheral edge; and wherein said first valve is secured to the surface so that fluid can flow past said peripheral edge of said first valve in order to escape the first bladder; and wherein said second valve is secured to the surface so that fluid can flow past said peripheral edge of said second valve in order to escape the first bladder.

40. The container lid of claim 34 wherein:

the first valve is secured to the surface thorough the port.

41. The container lid of claim 34 wherein:

said first valve has a stem that projects through the port in order to secure the first valve to the surface.

42. The container lid of claim 34 including:

a lever with a projection that can selectively contract and manipulate the second valve, which lever is secured to the second valve.

43. The container lid of claim 34 including:

said second valve is reenforced in order to spring back to a first undeformed shape.

44. The container lid of claim 34 wherein:

said first valve is concave and said second valve is concave with the first valve nested in the second valve.

45. The container lid of claim 34 wherein:

the first valve has a concave surface that faces the surface of the lid; and the second valve has a concave surface that faces the surface of the lid.

46. The container lid of claim 34 which can be manually operated.

47. The container lid of claim 34 which can be manually operated.

48. A container lid to create a vacuum within a container, the lid comprising:

a surface;

a first valve that can seal the container, which has a first concave surface facing the surface;

the first valve having a stem;

a second valve located above the first valve, the second valve having a concave surface facing the surface and with the first valve nested adjacent to the concave surface;

a first bladder defined between the first valve and the second valve;

a second bladder defined between the first valve and the surface; and a port through the surface that is adapted to communicate the container with the second bladder.

49. The container lid of claim 48 including a lever for manipulating the second valve.

50. The container lid of claim 48 including a lever having a projection that can selectively contract and manipulate the second valves.

51. The container lid of claim 48 including a container and the container lid can engage said container.

52. The container lid of claim 48 wherein:

said first valve has a peripheral edge and said second valve has a peripheral edge; and wherein said first valve is secured to the surface so that fluid can flow past said peripheral edge of said first valve in order to escape the second bladder; and wherein said second valve is secured to the surface so that fluid can flow past said peripheral edge of said second valve in order to escape the first bladder.

53. The container lid of claim 48 wherein:

the first valve is secured to the surface thorough the port.

54. The container lid of claim 48 wherein:

said first valve has a stem that projects through the port in order to secure the first valve to the surface.

55. The container lid of claim 48 including:

a lever for manipulating the second valve which lever is secured to the second valve.

56. The container lid of claim 48 including:

said second valve is reenforced in order to spring back to a first undeformed shape.

57. A container lid to manually create a vacuum within a container, the container lid comprising:

a surface having at least one perforation;

a guide connected with the surface;

a pump positioned over the surface to define a space, the pump located inside of the guide and held in position over the surface by the guide and said pump having an initial shape; and a valve coupled with the surface such that the at least one perforation is isolated from the space;

wherein when the pump is actuated, fluid within the space is forced out of the space between the surface and the pump;

wherein as the pump assumes the initial shape, the valve allows fluid to be communicated between the container and the space through the at least one perforation.

58. The container lid of claim 57, further comprising a lever connected with the surface to actuate the pump.

59. The container lid of claim 58, further comprising a collapsible plunger connected with the lever to actuate the pump.

60. The container lid of claim 57, wherein the valve includes a membrane, a stem, and a stopper.

61. A container lid to manually create a vacuum within a container, the container lid comprising:

a surface having at least one perforation;

a guide connected with the surface;

an outer valve positioned over the surface to define a space having an uncollapsed shape, the outer valve having a peripheral edge located inside of the guide and held in position over the surface by the guide; and an inner valve coupled with the surface such that the at least one perforation is isolated from the space;

wherein when the outer valve is collapsed, fluid within the space is forced out of the space between the peripheral edge and the surface;

wherein as the collapsed outer valve recovers such that the space assumes the uncollapsed shape, the inner valve allows fluid to be communicated between the container and the space through the at least one perforation.

62. The container lid of claim 61, further comprising a lever connected with the surface to collapse the outer valve.

63. The container lid of claim 62, further comprising a collapsible plunger connected with the lever to collapse the outer valve.

64. The container lid of claim 61, wherein the inner valve includes a membrane, a stem, and a stopper.

* * * * *